US009757634B1

(12) United States Patent
Fierro et al.

(10) Patent No.: US 9,757,634 B1
(45) Date of Patent: Sep. 12, 2017

(54) ATHLETIC SWING TRAINING DEVICE AND METHOD

(71) Applicants: Joseph Reza Fierro, Westminster, CO (US); Matthew Michael Vellone, Boulder, CO (US)

(72) Inventors: Joseph Reza Fierro, Westminster, CO (US); Matthew Michael Vellone, Boulder, CO (US)

(73) Assignee: Rocky Mountain Athletics Company, LLC, Westminster, CO (US)

( * ) Notice: Subject to any disclaimer, the term of this patent is extended or adjusted under 35 U.S.C. 154(b) by 0 days.

(21) Appl. No.: 14/726,574

(22) Filed: May 31, 2015

(51) Int. Cl.
*A63B 69/00* (2006.01)
*A63B 69/36* (2006.01)
*A63B 15/00* (2006.01)

(52) U.S. Cl.
CPC ..... *A63B 69/00* (2013.01); *A63B 69/0002* (2013.01); *A63B 69/3641* (2013.01); *A63B 15/005* (2013.01); *A63B 2069/0008* (2013.01); *A63B 2243/0004* (2013.01); *A63B 2243/0008* (2013.01); *A63B 2243/0029* (2013.01)

(58) Field of Classification Search
CPC ..... A63B 15/005; A63B 69/0002; A63B 2069/0008
USPC ..... 473/437, 457, 519
See application file for complete search history.

(56) References Cited

U.S. PATENT DOCUMENTS 1,020,551 A * 3/1912 Harania ..... A61B 5/224 73/379.01
3,572,706 A * 3/1971 Schroder ..... A63B 15/005 473/234
4,027,886 A * 6/1977 Katsube ..... A63B 69/3632 273/456
4,267,793 A * 5/1981 Lane ..... A63B 69/0002 116/203
4,809,975 A * 3/1989 Lee ..... A63B 15/005 473/256
4,967,596 A * 11/1990 Rilling ..... A63B 69/3632 473/233
5,360,209 A * 11/1994 Mollica ..... A63B 15/005 473/457
5,868,634 A * 2/1999 Choi ..... A63B 15/005 473/224
6,830,520 B1 * 12/2004 Bollar ..... A63B 15/005 473/457
6,955,610 B1 * 10/2005 Czaja ..... A63B 15/005 473/220

(Continued)

*Primary Examiner* — Mark Graham

(57) ABSTRACT

A training device and method for teaching a user the proper execution of various elements of an athletic swing. The swing training device incorporates a sliding member that simulates the impact of striking an object providing audible, visual and tactile feedback to the user pertaining to the proper execution of the swing, and displaces a force capture member a distance proportional to the force generated by the swing, and maintains this position until reset by the user. This allows the swing training device to quantify the force generated by the swing at the critical moment of impact. Further, the swing training device incorporates a movable stop that allows the device to be configured to provide for training methods that focus on the proper execution of specific swing elements, and it provides a means of quickly resetting the device for the execution of subsequent swing, thus maximizing training time.

17 Claims, 7 Drawing Sheets

(56) References Cited

U.S. PATENT DOCUMENTS

| | | | | |
|---|---|---|---|---|
| 7,235,020 | B1 * | 6/2007 | Christensen | A63B 69/3617<br>473/226 |
| 7,297,077 | B1 * | 11/2007 | Battaglino | A63B 59/00<br>473/422 |
| 7,297,078 | B2 * | 11/2007 | Libonati | A63B 15/005<br>473/422 |
| 7,618,328 | B2 * | 11/2009 | Davenport | A63B 69/3623<br>473/219 |
| 7,993,219 | B2 * | 8/2011 | Whitney | A63B 69/0002<br>473/457 |
| 8,540,584 | B1 * | 9/2013 | Sorenson | A63B 69/36<br>473/219 |
| 8,936,522 | B2 * | 1/2015 | Weston | A63B 15/00<br>473/422 |
| 9,144,726 | B2 * | 9/2015 | Whitney | A63B 69/0002 |
| 2004/0048696 | A1 * | 3/2004 | Ciesar | A63B 69/0002<br>473/457 |
| 2005/0009618 | A1 * | 1/2005 | Leadbetter | A63B 53/14<br>473/257 |
| 2010/0234144 | A1 * | 9/2010 | Sutlovich | A63B 69/0002<br>473/457 |
| 2010/0248867 | A1 * | 9/2010 | Tande | A63B 15/005<br>473/457 |
| 2011/0034275 | A1 * | 2/2011 | Kim | A63B 15/005<br>473/457 |

* cited by examiner

ATHLETIC SWING TRAINING DEVICE AND METHOD

CROSS-REFERENCE TO RELATED APPLICATIONS

This application claims the benefit of provisional patent application Ser. No. 62/006,047, filed on May 31, 2014 by a present inventor.

FIELD OF THE INVENTION

The present invention relates to a training device and method for teaching a user the proper execution of an athletic swing such as those used in baseball, softball, golf, tennis and the like. In particular, the present invention relates to a training device that teaches the proper timing and coordination of the user's body during the execution of an athletic swing such that optimal athletic results are achieved.

BACKGROUND OF THE INVENTION

A seemingly countless number of devices designed to improve the performance of athletic swings have been patented in the history of athletic training. Of these devices a notable subset provide audible, visual or tactile feedback to the user pertaining to the proper timing of the execution of the swing being trained. Of this subset there is still an impressive quantity of patents pertaining to feedback provided by a moveable member propelled by the centrifugal acceleration of the swing along the axis of an elongated member striking a fixed implement attached to said member. Of such devices the following is a tabulation of some prior art that presently appears relevant:

| Pat. No. | Issue Date | Patentee |
|---|---|---|
| 3,136,546 | June 1964 | Connolly |
| 3,137,504 | June 1964 | Zordan et al. |
| 5,360,209 | November 1994 | Mollica |
| 5,577,966 | November 1996 | Duran |
| US 2002/0072041 A1 | June 2002 | Gallagher et al. |
| U.S. Pat. No. 6,949,036 B2 | September 2005 | Ciesar et al. |
| U.S. Pat. No. 8,187,124 B2 | May 2012 | Ciesar et al. |

While the feedback provided by the devices cited above is indeed valuable, these devises do not quantify the force or velocity of the swing being trained. Without this feedback the effectiveness of these devices is limited.

An additional subset of devices designed to improve the performance of athletic swings seek to quantify the velocity or force generated by the swing. This feedback can then be used by the user to improve the velocity or force of their swing. Of such devices, the following is a tabulation of some prior art that presently appears relevant:

| Pat. No. | Issue Date | Patentee |
|---|---|---|
| 4,967,596 | November 1990 | Rilling et al. |
| U.S. Pat. No. 6,805,005 B1 | October 2004 | Elizondo |
| US 2002/0094888 A1 | July 2002 | LaChance et al. |

Again, the feedback provided by these devices is indeed valuable, however these devices do not provide feedback pertaining to the point during the swing in which the maximum velocity or force is achieved. Without this feedback the effectiveness of these devices is limited.

A third, and most recent, subset of devices designed to improve the performance of athletic swings seeks to close the gap between the two subsets previously cited by providing both an audible, visual or tactile feedback to the user; and by attempting to quantify the velocity or force generated by the swing. Of such devices the following is a tabulation of some prior art that presently appears relevant:

| Pat. No. | Issue Date | Patentee |
|---|---|---|
| 3,572,706 | June 1969 | Schroder |
| U.S. Pat. No. 7,618,328 B2 | November 2009 | Davenport et al. |
| US 2002/0034275 A1 | February 2011 | Kim |
| U.S. Pat. No. 7,993,219 B2 | September 2011 | Whitney et al. |

The devices cited above provide an improvement over the previous two subsets, unfortunately these devices are also of limited effectiveness in that they require the user to configure the device prior to the execution of the swing. This effectively provides the user with only binary feedback pertaining to the velocity or force generated by any particular swing (i.e. if the swing does or does not meet or exceed the preconfigured velocity or force). Further, it is believed by this author that such binary feedback encourages the user to sacrifice form and tempo in the achievement of the pre-configured velocity or force. Because of this limited feedback the effectiveness of these devices is limited.

Of the prior art, the work of Sutlovich et al. in patent US 2010/0234144 A1, 2010 Sep. 16 is also noteworthy. This patent notes the importance of "making contact at the exact moment that the bat velocity reaches its maximum point," however the device described in this patent does not quantify the velocity at the moment of impact.

Finally, the author also notes that none of the prior art specimens that can presently be identified provide a means of adjusting the starting position of the sliding members of their designs in order to allow for the training of multiple elements of an athletic swing.

SUMMARY OF THE INVENTION

The present invention relates to a training device and method for teaching a user the proper execution of various elements of an athletic swing such as those used in baseball, softball, golf and the like. The swing training device includes a shaft with a grip and a knob attached at one end. Along the axis of the shaft is a movable stop and a sliding member. The movable stop provides the ability to vary the starting position of the sliding member, providing for a variety of training methods to be performed that allow for focused training of the proper execution of specific elements of an athletic swing.

Movably held at the opposite end of the shaft is a force capture member comprised of; a cap, a force indicator, and a friction device. During the execution of a swing the centripetal acceleration generated by the swing causes the sliding member to travel down the shaft striking the force capture member producing an audible, tactile and visual feedback to said user and simulates the striking of an object. Further, the force capture member is displaced a distance proportional to the velocity of the sliding member and maintains this position until reset by the user. This allows the swing training device to quantify the force generated by the swing at the moment of impact for a wide range of results without the need for the device to be configured for a specific result prior to the execution the swing. Further, a means of retaining the sliding member in the starting position is provided that allows the swing training device to be used to train a multitude of athletic swings, particularly those performed on a vertical plain such as golf swings.

Contained within the shaft is a reset linkage that connects the force capture member to a restraining member comprised of; a reset grasp, and a retaining stop. The retaining member provides a means of restricting the displacement of the force capture member to a desired distance, and provides a means of quickly resetting the device for the execution of subsequent swing, thus maximizing training time. Training methods using the swing training device are provided that improve athletic performance, and allow for focused training of the proper execution of specific elements of an athletic swing.

Figure 1A:
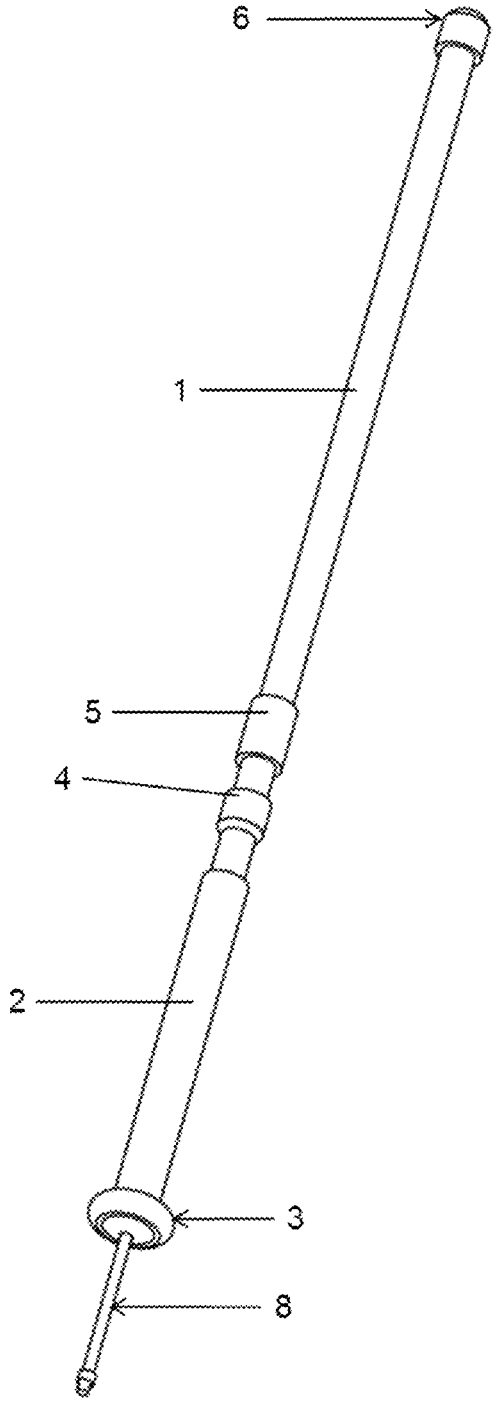
FIG. 1A is a perspective view of one embodiment of this invention in a first position.

| Drawing Reference Numerals | | |
|---|---|---|
| 1-Shaft | 6-Force Capture Member | 8-Retaining Member |
| 2-Grip | 6a-Cap | 8a-Reset Grasp |
| 3-Knob | 6b-Force Indicator | 8b-Retaining Stop |
| 3a-Reset Passage | 6c-Friction Device | 9-User |
| 4-Movable Stop | 7-Reset Linkage | 10-Retaining Flange |
| 5-Sliding Member | | |

DETAILED DESCRIPTION OF SPECIFIC EMBODIMENTS

First Embodiment—FIGS. 1A, 1B, 2A, 2B, 2C, 3

Referring to FIGS. 1A-3, one embodiment of the swing training device is shown. Specifically, these figures show a swing training device comprising a shaft 1, with a grip 2 and a knob 3, attached at one end. Along the axis of the shaft 1 is a movable stop 4, and a sliding member 5. At the opposite end of the shaft 1 is a force capture member 6, comprised of: a cap 6*a*, a force indicator 6*b*, and a friction device 6*c*. Contained within the shaft 1 is a reset linkage 7 that connects the force capture member 6 to a restraining member 8, comprised of: a reset grasp 8*a*, and a retaining stop 8*b*.

The shaft 1 of this embodiment is the central structural member of the swing training device consisting of a hollow elongated member by which the swing training device is swung. I presently contemplate that the shaft of this embodiment be made of uniform diameter of approximately the diameter of the grip portion of a typical baseball bat, softball bat, golf club, tennis racket or similar athletic equipment, and be made of a rigid and durable plastic or carbon fiber material. The shaft can be made of: various lengths, and alternate materials, such as high carbon steel, titanium, polycarbonate, etc. in order to better emulate the physical characteristics of the athletic equipment being trained. The grip 2 is the portion of the shaft 1 grasped by the user while executing a swing, which may be covered in a suitable gripping material such as leather, rubber, foam, or a synthetic material, etc. I presently contemplate the knob 3 to be attached to the shaft 1 by a threaded union, welding, epoxy, glue or other suitable method. The knob 3 of this embodiment approximates the knob of a typical baseball or softball bat. However, the knob 3 can be made of alternative geometries in order to better emulate the physical characteristics of the athletic equipment being trained. The knob 3 provides a reset passage 3*a* through which the retaining member 8 moves during the execution of the swing. This passage, and the retaining member 8 may be made of varying geometries or materials in order to provide resistance to accommodate swing being trained, or strength or abilities of the user.

The movable stop 4 is movably attached to the external surface of the shaft 1, and is of sufficient diameter to retain the sliding member 5 allowing the user to move it along the shaft in order to vary the starting position the sliding member 5. This allows for the swing training device to be configured for the training of multiple swing elements. I presently contemplate that the movable stop 4 to be made of a compliant material such that it is held in place against the shaft 1 by friction. However, the movable stop 4 can be made with a secondary element that actively applies a force against the shaft 1 to secure it in the desired starting position. The sliding member 5 is slidably attached to the shaft 1 and slides along the shaft between the movable stop 4 and the force capture member 6. I presently contemplate that the movable stop 4 and sliding member 5 be made of suitable materials, or contain suitable materials, such that the sliding member 5 is releasably retained against the movable stop 4 at the starting position.

At the end of the shaft 1 opposite the knob 3 is the force capture member 6 comprised of: the cap 6*a*, the force indicator 6*b*, and the friction device 6*c*. The cap 6*a* encloses the end of the shaft 1, and is of sufficient diameter to retain the sliding member 5. The force capture member 6 provides a means of measuring the force generated by the swing. This measurement may be calibrated to provide quantitative force measurements, however I presently suggest that relative or qualitative feedback provides sufficient data to improve athletic performance. The force capture member 6 is held against the shaft 1 by friction. I presently contemplate that the components 6*a*, 6*b* and 6*c* of the force capture member 6 of this be made of a single molded member of rigid durable plastic. However, these components may be independent members that are attached by threaded unions, welding, epoxy, glue or other suitable method, and may be independently made of varying materials such as rubber, polycarbonate, high carbon steel, titanium, etc., in order to provide the desired resistance for the swing being trained, strength or abilities of the user.

The force capture member 6 is attached to the retaining member 8 by means of the reset linkage 7. The reset linkage 7 is a rope, cable or rigid member connecting the force capture member 6 to the retaining member 8. The connection of the reset linkage 7 to the friction device 6 and retaining member 8 may be achieved by knotting, welding, epoxy, glue or other suitable method. The retaining member 8 is comprised of the reset grasp 8*a* and retaining stop 8*b*. The reset grasp 8*a* moves through the reset passage 3*a* of the knob 3 while the swing training device is used, and the retaining stop 8*b* constrains the movement of force capture member 6 to a desired distance. I currently contemplate that the reset grasp 8*a* and retaining stop 8*b* be made of a single rope element with the retaining stop 8*b* formed by a knot in said rope. However, the reset grasp 8*a* may be a rope, cable, or rigid member of suitable material and the retaining stop 8*b* may be made of any viable material securely attached to the rest grasp 8*a* and of sufficient diameter to not pass through the reset passage 3*a* within the knob 3. While I currently contemplate that the measurement of the force of the swing will be provided by the force indicator 6*b*, it is also true that the reset grasp 8*a* will move a distance proportional to the force indicator 6*b*. As such, the reset grasp 8*a* may alternatively provide a means of measuring the speed or force generated by the swing.

I presently contemplate that the knob 3, movable stop 4, sliding member 5 and the cap 6*a* of the force capture member 6, be made of a high contrasting color providing for enhanced visual assessment of swing mechanics. The intent of the high contrast color is to be a color with great contrast to the shaft 1 and knob 3, and thus easily identifiable by the user.

Operation of First Embodiment—FIGS. 1A, 1B, 4A-4D, 5A-5B, 6A-6B The swing training device describe above includes a movable stop 4 that allows for a variety of training methods. Referring to FIGS. 4A, 4B, 4C and 4D a first training method is described. This training method is intended to teach the proper engagement of the user's wrists when performing an athletic swing and provides audible, tactile and visual feedback to the user pertaining the timing of and force generated at the moment of full extension of the swing and simulates the striking of an object.

Figure 1B:
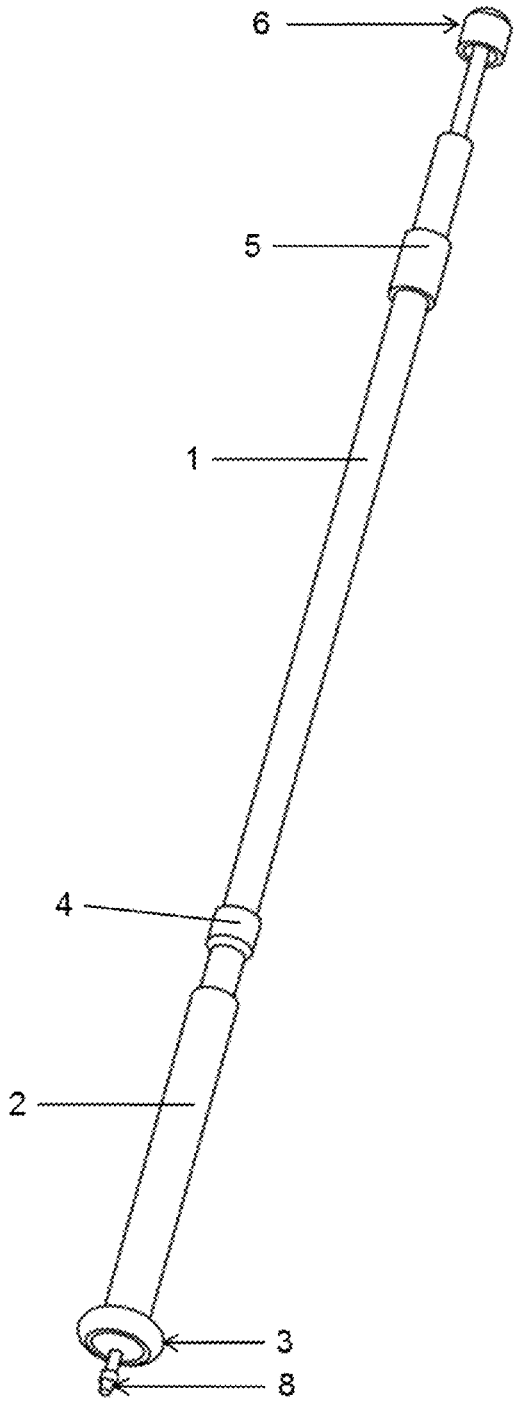
FIG. 1B is a perspective view of the embodiment of FIG. 1A in a second position.
Figure 2A:
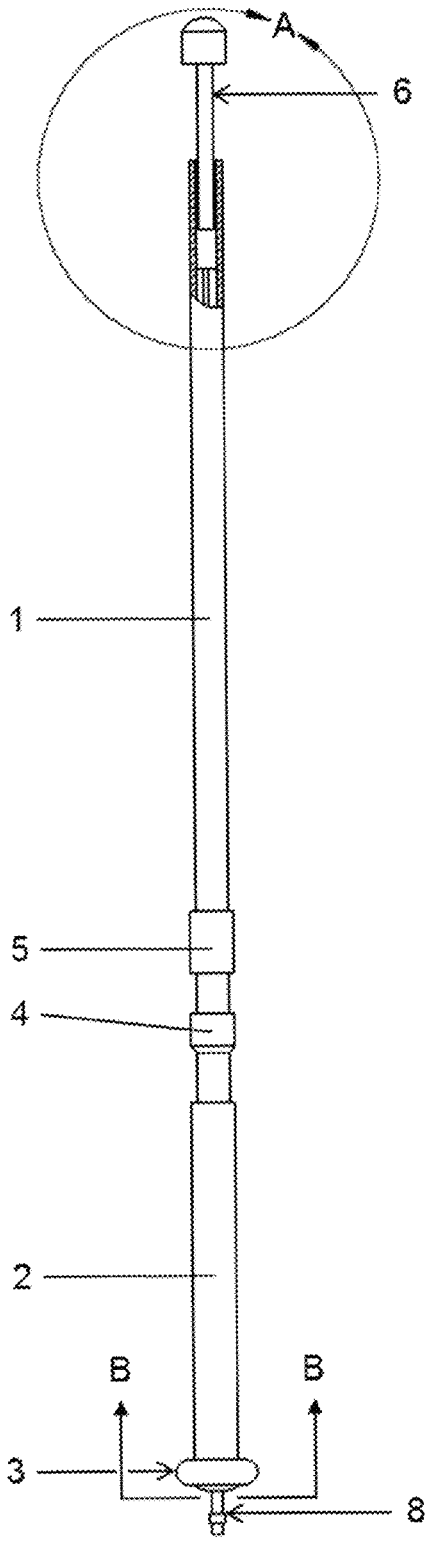
FIG. 2A is a front view of the embodiment of FIG. 1A with a cutaway at one end to show internal component.
Figure 2B:
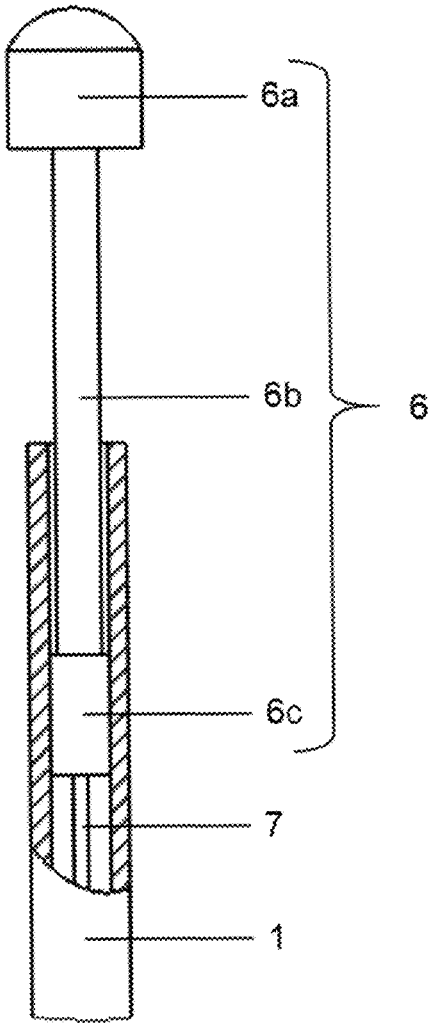
FIG. 2B is an enlarged view of detail A of FIG. 2A.
Figure 2C:
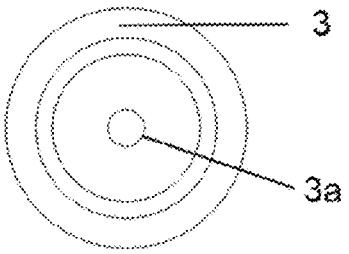
FIG. 2C is a cross-section view taken along lines B-B of FIG. 2A.
Figure 3:
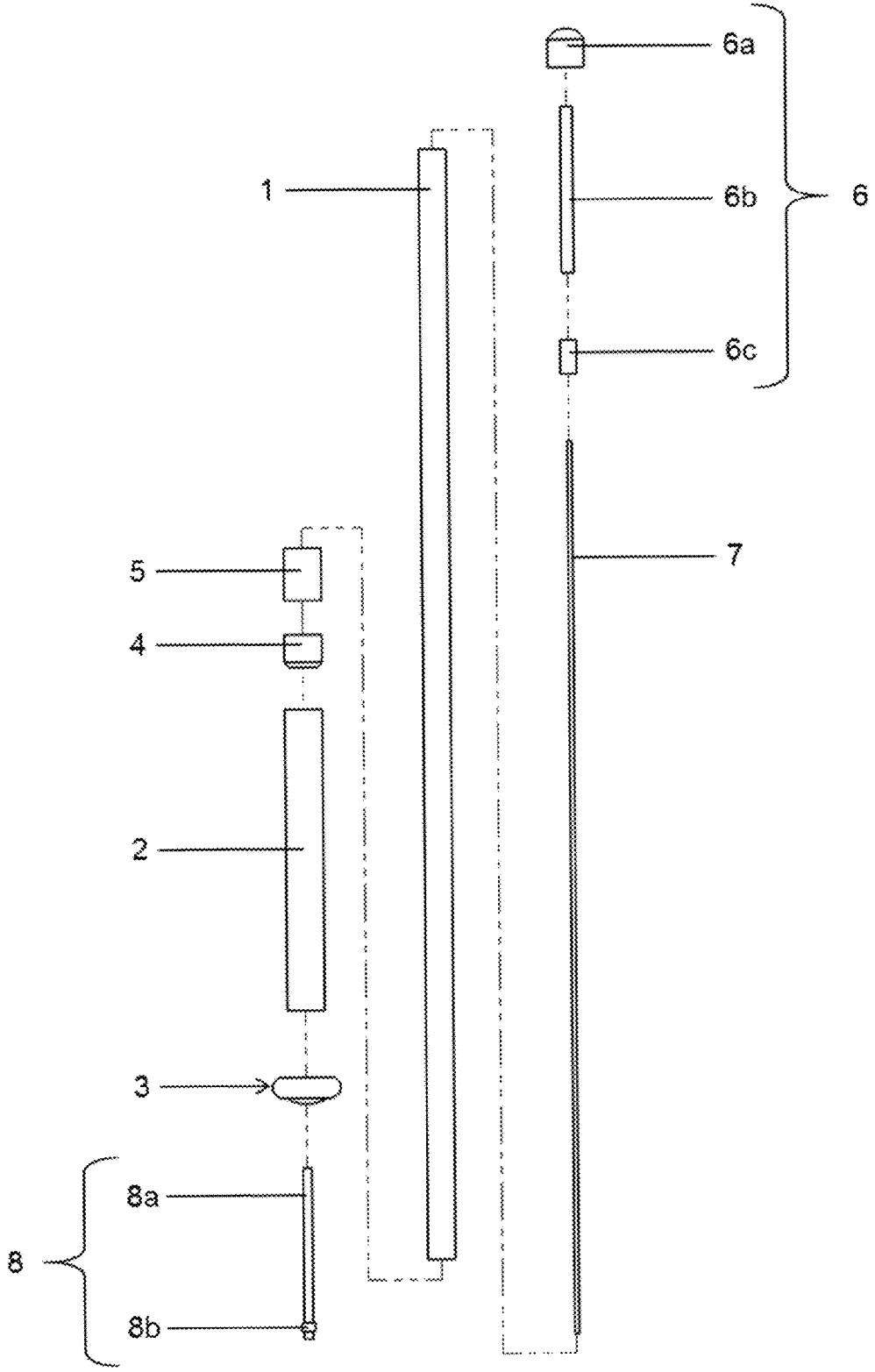
FIG. 3 is the exploded view of the embodiment of FIG. 1A.
Figures 4A, 4B, 4C, 4D:
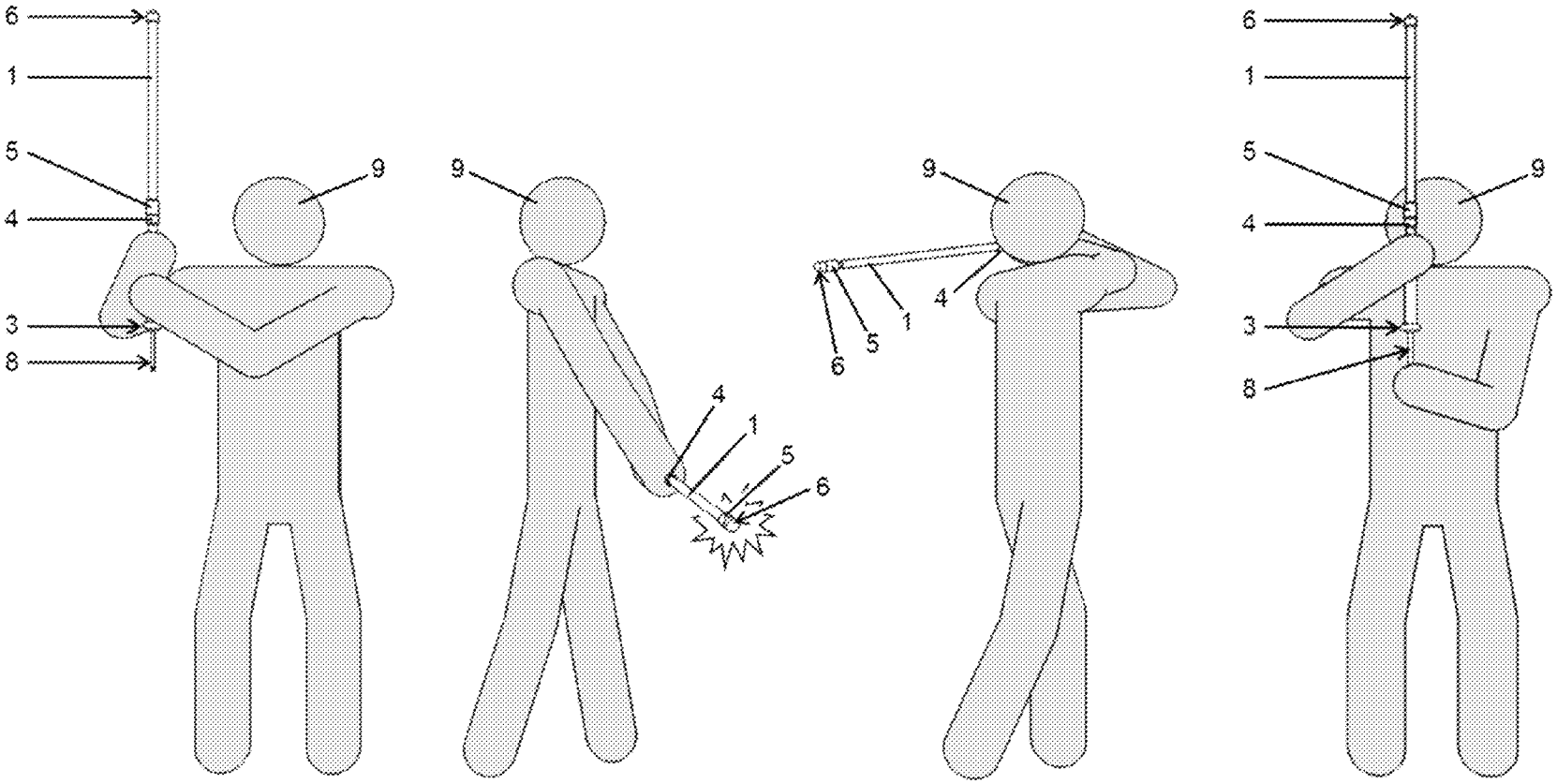
FIGS. 4A, 4B, 4C, 4D illustrate a first training method using the embodiment of FIG. 1A.

In this method the swing training device is held at the grip 2 by a user 9 with both hands while the swing is performed with the movable stop 4 at the full downward position (closest to the user's hands). In the starting position (FIG. 4A) the sliding member 5 rests against the movable stop 4 and the force capture member 6 is fully retracted into the shaft 1 (FIG. 1A). The swing is then performed. The centrifugal acceleration generated by the user's swing propels the sliding member 5 along the shaft 1 until is strikes the force capture member 6 producing an audible "cracking" sound and tactile feedback to the user, thus simulating the impact of striking an object (FIG. 4B). The timing of this impact (sound) provides immediate feedback to the user of the timing of the swing, which may be aided by the visual feedback provided high contrast colors used on the swing training device. Optimal performance is achieved when the sliding member 5 strikes the force capture member 6 as the user's wrists are extended at the ideal moment of the swing. The force generated by the sliding member 5 striking the force capture member 6 displaces the force capture member 6 along the axis of the swing training device (away from the user's hands) where it maintains this position through completion of the swing (FIGS. 1B, 4C). The displacement of the force capture member 6 is proportional to the velocity of the sliding member 5 upon striking the force capture member 6. As such the swing training device measures the force achieved at the moment of simulated impact. This measurement can be relative or calibrated, but it is important to remind the reader that the moment of impact is the critical moment of the swing and providing a means of measuring the force or speed achieved at this moment is of immense training value.

Upon completing the swing, the user is able to quickly view the force of the swing by examining the displacement of the force capture member 6, or alternately of the displacement of the retaining member 8. The swing training device can then be quickly reset by pulling on the retaining member 8 in preparation for the execution of the next swing (FIG. 4D). This design element allows the user to optimize training time by performing a maximum number of repetitions as the swing training device feedback and reset are executed without significantly altering the swinging position.

Figure 5A:
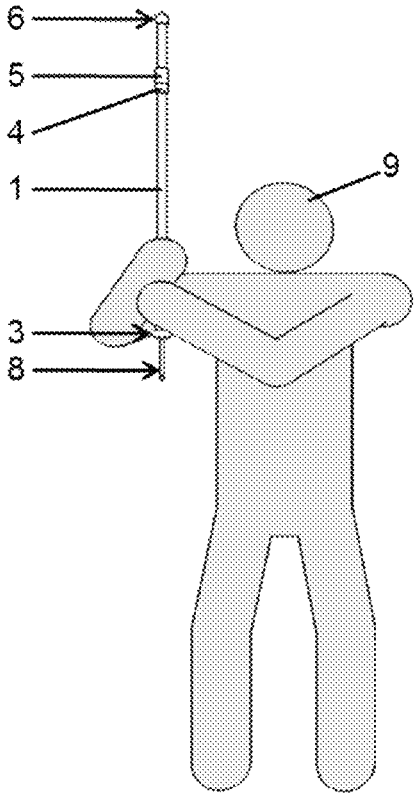
FIGS. 5A, 5B illustrate a second training method using the embodiment of FIG. 1A.
Figure 5B:
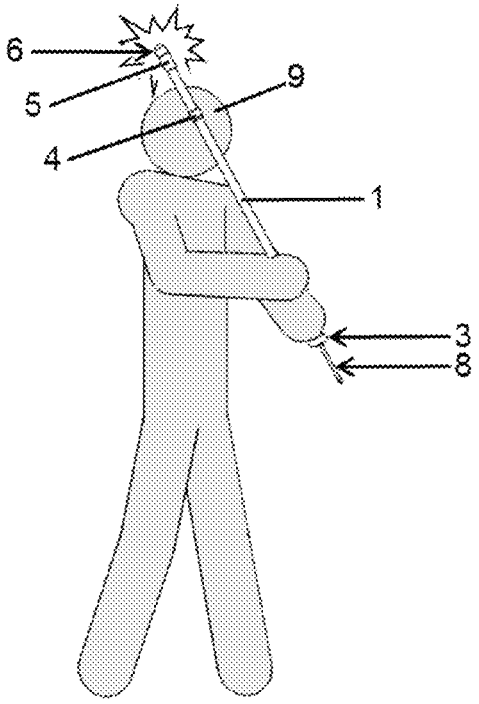

Referring to FIGS. 5A and 5B a second training method is described. In the proper execution of an athletic swing such as that used in baseball or golf the hands lead the bat or club through the swing. This training method is intended to teach the proper starting motion of the user's hands at the start of such a swing. In this method the swing training device is held at the grip 2 by a user 9 with both hands with the movable stop 4 positioned along the shaft 1 near the force capture member 6 providing for only a few inches of movement of the sliding member 5. The sliding member 5 rests against the movable stop 4 and the force capture member 6 is fully retracted into the shaft 1 (FIG. 1A, 5A). The swing is then performed. With the movement of the sliding member 5 restricted to only a few inches the audible, tactile and visual feedback is provided upon the first motion of the swing training device during the swing (FIG. 5B), thus the user is provided immediate feedback pertaining to the timing of the users upper body (arms/hands) engaging in the swing. This feedback allows the user 9 to improve the coordination of the lower body and upper body in the swing as well as providing immediate feedback to correct any undesirable motion of the swing training device during the swing, such as early extension of the wrists.

Figure 6A:
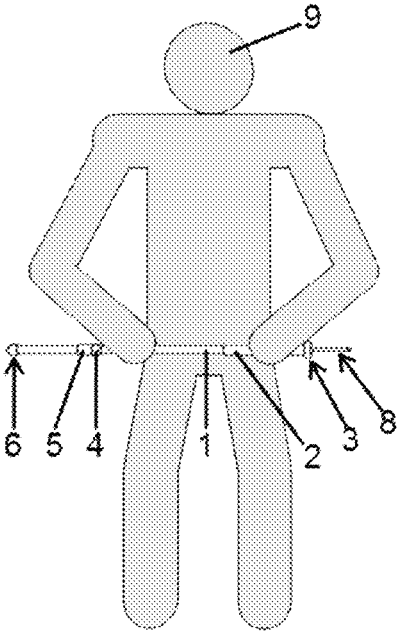
FIGS. 6A, 6B illustrate a third training method using the embodiment of FIG. 1A.
Figure 6B:
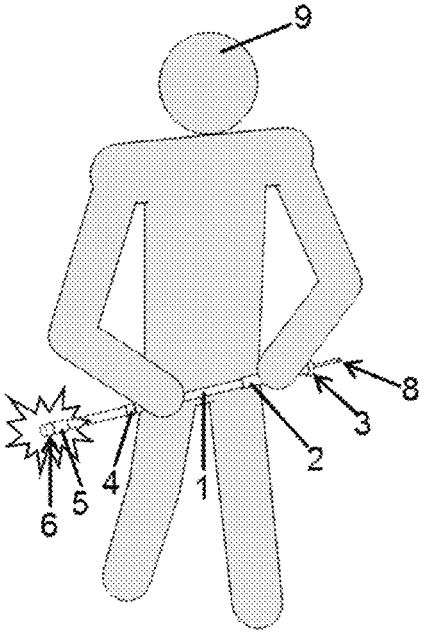
Figure 7A:
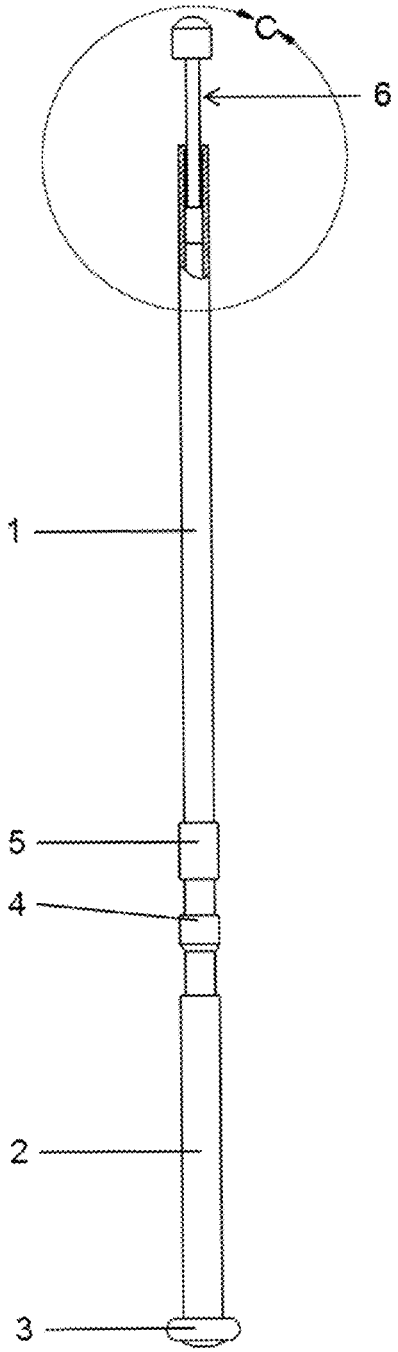
FIG. 7A is a front view of a second embodiment of this invention with a cutaway at one end to show internal component.
Figure 7B:
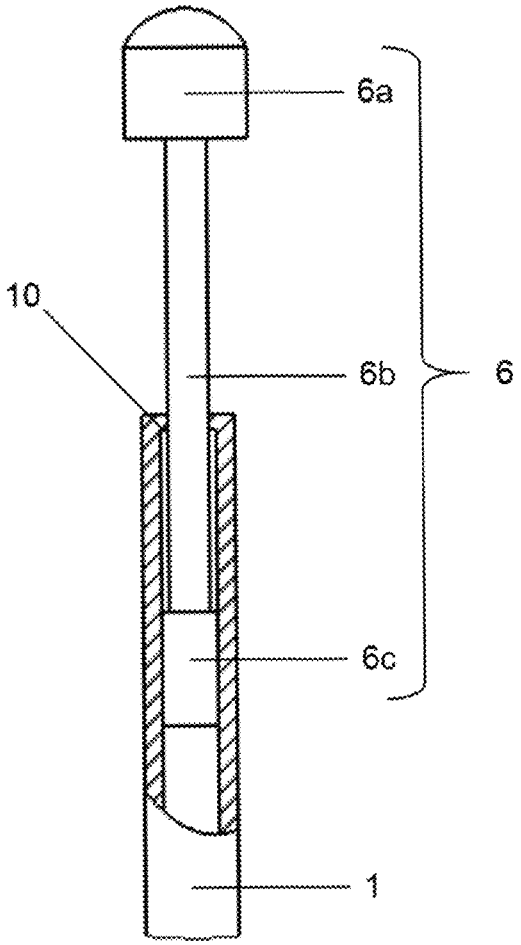
FIG. 7B is an enlarged view of detail C of FIG. 7A.

Referring to FIGS. 6A and 6B a third training method is described. In the teaching of a baseball or softball swing a common drill known as "squash the bug" is often instructed. In this drill the user is instructed to forcibly pivot their lower body as if squashing a bug, thus teaching the user the proper engagement of the lower body in an athletic hip turn. A common evolution of this drill requires the user to grasp a bat held against their waist or behind their back while executing the same motion. In this training method the same technique is employed, however the swing training device s aids this training by producing a satisfying "cracking" sound produced by the sliding member 5 striking the force capture member 6 during the execution of this drill. In the starting position the user holds the swing training device against their hips, or alternatively behind their back (not shown) with the movable stop 4 positioned along the shaft 1 near the force capture member 6. The sliding member 5 rests against the movable stop 4 and the force capture member 6 is fully retracted into the shaft 1 (FIG. 1A, 7A). The "squash the bug" motion is then executed, and the centrifugal acceleration of the turning of the user's hips propels the sliding member 5 along the shaft 1 until it strikes the force capture member 6 producing and audible "cracking" sound (FIG. 7B). This feedback enhances the drill by providing a satisfying result, and aids in the ability to instruct the drill to the user.

Description and Operation of Alternative Embodiments—FIGS. 7A, 7B, 8A, 8B The first embodiment of this invention is intended to be the broadest embodiment, comprising a set of novel features of great utility that provide an improved swing training device. The following alternative embodiments are intended to highlight the specific novel features of this invention and represent embodiments that independently incorporate these features.

Referring to FIGS. 7A and 7B, a second embodiment of the swing training device is shown. This embodiment removes the use of the reset linkage and retaining member of the first embodiment and provides a retaining flange 10 to retain a force capture member 6 when the swing training device is used. Specifically, this figure shows a swing training device comprising a shaft 1, with a grip 2 and a knob 3, attached at one end. Along the axis of the shaft 1 is a movable stop 4, and a sliding member 5. At the opposite end of the shaft 1 is a retaining flange 10, and a force capture member 6, comprised of: a cap 6*a*, a force indicator 6*b*, and a friction device 6*c*.

The description of this second embodiment is similar to the first embodiment with the exception of consideration to accommodate the lack of the need for the reset linkage and retaining member of the first embodiment. The shaft 1 of this second embodiment is an elongated member with a hollow portion at one end minimally sized to accommodate the force capture member 6. I presently contemplate that the shaft of this embodiment be made of uniform diameter of approximately the diameter of the grip portion of a typical baseball bat, softball bat, golf club, tennis racket or similar athletic equipment, and be made of a rigid and durable plastic or carbon fiber material. The shaft can be made of: various lengths, and alternate materials, such as high carbon steel, titanium, polycarbonate, etc. in order to better emulate the physical characteristics of the athletic equipment being trained.

At the end of the shaft 1 opposite the knob 3 is the force capture member 6, comprised of: the cap 6*a*, the force indicator 6*b*, and the friction device 6*c*. The cap 6*a* encloses the end of the shaft 1, and is of sufficient diameter to retain the sliding member 5. The retaining flange 10 constrains the movement of force capture member 6 to a desired distance. I presently contemplate that the components 6*a*, 6*b* and 6*c* of the force capture member 6, of this embodiment be independent members that are slidably attached to the retaining flange 10 and are then attached by threaded unions, welding, epoxy, glue or other suitable method, and may be independently made of varying materials such as rubber, polycarbonate, high carbon steel, titanium, etc., in order to provide the desired resistance for the swing being trained, strength or abilities of the user. The retaining flange 10, now encompassing the force capture member 6 is then similarly attached by threaded unions, welding, epoxy, glue or other suitable method to the shaft 1. However, any suitable means of manufacture and assembly is acceptable.

The method of operating the second embodiment described above is the same as the method of operating the first embodiment with the exception that the method of resetting the force capture member 6 is achieved by the user applying a force (pushing) the displaced force capture member toward the opposite end of the shaft 1 until it is returned to the starting position. This embodiment is intended to provide a swing training device for use with athletic swings in which a retaining member protruding from the knob end of the device is not desired.

Figure 8A:
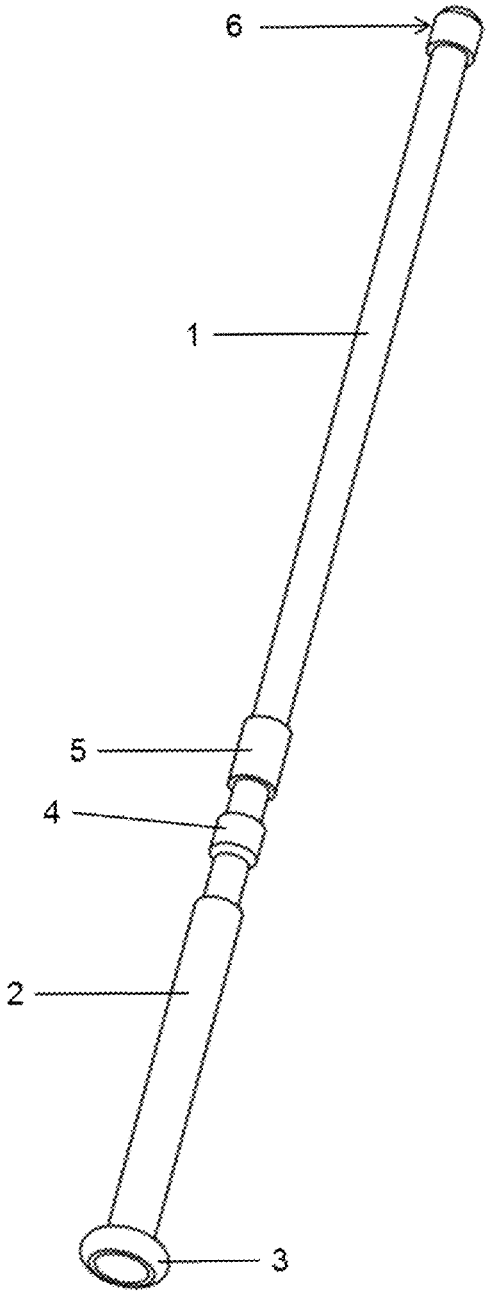
FIG. 8A is a perspective view of a third embodiment of this invention in a first position.
Figure 8B:
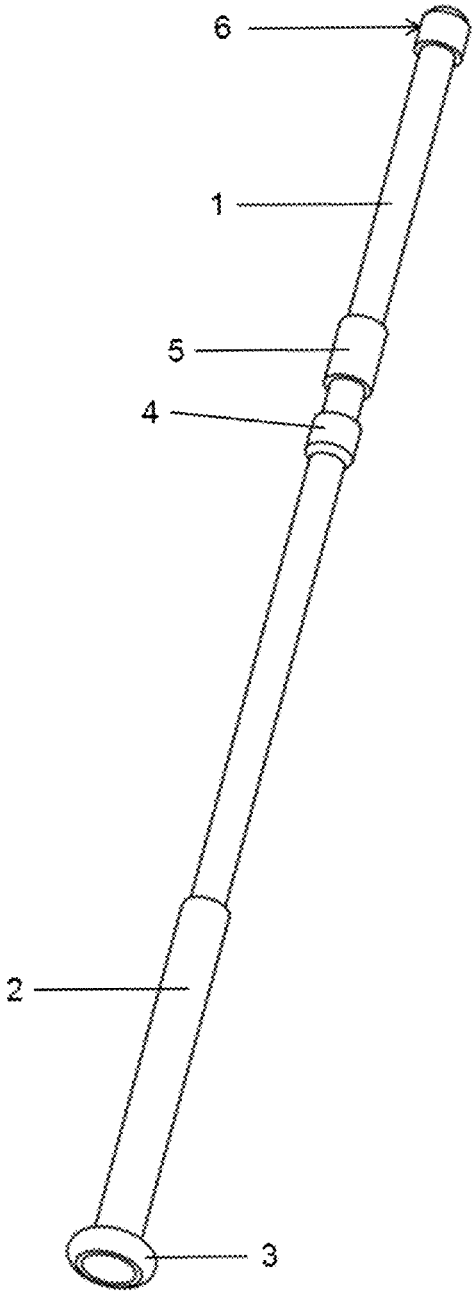
FIG. 8B is a perspective view of the embodiment of FIG. 8A in a second position.

Referring to FIGS. 8A and 8B, a third embodiment of the swing training device is shown. This embodiment further removes the feedback provided by the displacement of the force capture member of the previous two embodiments. Specifically, these figures show a swing training device comprising a shaft 1, with a grip 2 and a knob 3, attached at one end. Along the axis of the shaft 1 is a movable stop 4, and a sliding member 5. At the opposite end of the shaft 1 is a force capture member 6 that is rigidly affixed to the shaft. In this embodiment, the cap 6*a* is the only component of the force capture member 6 that is required.

The description of this second embodiment is similar to the second embodiment with the exception of consideration to accommodate the force capture member 6 rigidly attached to the shaft 1. The shaft 1 of this third embodiment is an elongated member that may be made of a hollow or solid cross section. I presently contemplate that the shaft of this embodiment be made of uniform diameter of approximately the diameter of the grip portion of a typical baseball bat, softball bat, golf club, tennis racket or similar athletic equipment, and be made of a rigid and durable plastic or carbon fiber material. The shaft can be made of; various lengths, and alternate materials, such as high carbon steel, titanium, polycarbonate, etc. in order to better emulate the physical characteristics of the athletic equipment being trained. At the end of the shaft 1 opposite the knob 3 is the force capture member 6 that encloses the end of the shaft 1, and is of sufficient diameter to retain the sliding member 5. I presently contemplate the force capture member 6 to be attached to the shaft 1 by a threaded union, welding, epoxy, glue or other suitable method.

The method of operating the third embodiment described above is the same as the method of operating the second embodiment with the exception that this embodiment provides only audible, tactile and visual feedback to the user pertaining the timing of the swing at the moment of full extension of the swing and simulates the striking of an object. This embodiment is intended to provide a simplified swing training device for use with younger athletes or in instanced where the feedback provided by the displacement of the force capture member is of limited training value, and to provide a lower cost swing training device.

ADVANTAGES

From the description above, a number of advantages of some embodiments of my swing training device become evident:

(a) A user may think they are performing each swing identical to a preceding swing, however subtle and often unnoticed difference such as grip pressure, stride length, etc. can have great impacts on the force generated by the swing. The force capture member of at least one embodiment descried above provides for a multitude of force measurements, thus the force generated by a swing may be quickly compared the force generated by subsequent swings without the need to reconfigure the device from one swing to the next. As such, the training utility of my swing training device provides an advantage over prior at devices.

(b) Optimal results of an athletic swing are achieved when a user strikes an object, such as a ball, puck, etc., at the precise moment their swing is fully extended with a forceful snap of the wrists. The swing training device of at least one embodiment described above provides audible, tactile and visual feedback to the user pertaining the timing of the swing at the moment of full extension and simulates the striking of an object. This visual feedback can be aided by the use of contrasting colors incorporated into the design. Further, at least one embodiment above provides quantifiable feedback at precisely the moment of full extension of the user's swing. Thus, a novel training device and training methods are provided that allow the user to optimize the timing and force at this critical moment of the swing. As such the training utility of my swing training device provides an advantage over prior art devices.

(c) At least one embodiment described above, provides a means of quickly resetting the swing training device that minimally alters the training position, thus training time is maximized by allowing the user to perform a maximum number of swings in a given period of time.

(d) The movable stop of at least one embodiment described above provides for a plurality of training methods to be performed by the swing training device. This novel feature of my swing training device provides utility over the prior art devices by allowing for training methods specifically designed to focus training on various elements of a swing.

(e) Further, the movable stop described above provides a means of retaining the sliding member in the starting position. This design element allows the swing training device to be used to train a multitude of athletic swings, particularly those performed on a vertical plane such as golf swings.

(f) Lastly the swing training device described above is easily scalable to accommodate a broad range of athletic equipment and user abilities. Thus, an effective and low cost training device can be provided for the training of athletic swings at all levels of athletics and related leisure activities.

CONCLUSION, RAMIFICATIONS AND SCOPE

Accordingly, the reader will see that the swing training device of the various embodiments provides a swing training device and training methods that aid a user in developing optimal athletic results by training multiple elements of a swing, and in at least one embodiment quantifying the results of said swing. The swing training device can be used to quantify the force produced by the swing of a user for a multitude of swings without the need to be configured from one swing to the next, and provides audible, tactile and visual feedback to the user pertaining the timing of the swing at the moment of full extension and simulates the striking of an object. This visual feedback can be aided by the use of contrasting colors incorporated into the design. Further, at least one embodiment above provides quantifiable feedback at the critical moment of full extension of the user's swing. The movable stop provides for a plurality of training methods to be performed with the swing training device, and allows for training methods specifically designed to focus training on various elements of a swing. Additionally, the movable stop described above provides a means of retaining the sliding member in the starting position allowing the swing training device to be used to train a multitude of athletic swings, particularly those performed on a vertical plane such as golf swings.

Although the description above contains many specificities, these should not be construed as limiting the scope of the embodiments but as merely providing illustrations of some of several embodiments. For example, the use of a grip and a knob on the swing training device is not critical to the function or training utility of the device but rather serves to aid the comfort and physical interpretation of the device for the user. One skilled in the art will recognize that the swing training device can be made of varying form factors intended to represent alternative athletic equipment, such as a golf club, cricket bat, tennis racket, etc. without departing from the objects of the invention. Additionally, the training methods of the embodiments are representative and illustrate the versatility of the movable stop, and are not intended to be inclusive of all training methods provided by the swing training device. For example, training methods employing the use of only one hand of the user further provide for focused training on one or more elements of a swing. Further, depending on the specific implementation of the design of the swing training device, the swing training device may be used to strike objects such as a baseball, golf ball, tennis ball, etc. or representative training balls thereof; or be made of varying materials to provide for a training device of a weight significantly greater or less than the weigh the athletic equipment used in the sport being trained.

Thus the scope of the embodiments should be determined by the appended claims and their legal equivalents, rather than by the examples given.

What is claimed:

1. A swing training device, comprising:

a. a shaft having a first and a second end;

b. a movable stop mounted on said shaft providing a plurality of starting positions of a sliding member;

c. a force capture member movably held at said first end of said shaft;

d. said sliding member slidably mounted on said shaft between said movable stop and said force capture member;

e. a bore through the length of said shaft within which said force capture member is connected to a restraining member passing through and protruding from said second end of said shaft;

f. whereby said sliding member slides along said shaft between said movable stop and said force capture member, the striking of said sliding member against said force capture member displaces said force capture member such that the force generated by a swing is quantified for a plurality of results, and said swing training device provides a plurality of training configurations for the training of a plurality of swing elements and can be reset to a starting position without significantly altering the training position.

2. The swing training device of claim 1 wherein the striking of said sliding member against said force capture member provides audible, tactile and visual feedback.

3. The swing training device of claim 1 wherein said shaft retains said force capture member when said swing training device is used.

4. The swing training device of claim 1 wherein said movable stop retains said sliding member in a starting position, whereby said sliding member is maintained in said starting position when said swing training device is held with said first end positioned below said second end.

5. The swing training device of claim 4 further comprising a plurality of magnets or magnetic material incorporated in said movable stop or said sliding member.

6. The swing training device of claim 1 further comprising a grip and a knob at said second end of said shaft.

7. The swing training device of claim 6 wherein said sliding member, said movable stop, said force capture member and said knob are of a different color than said shaft and said grip.

8. A swing training device, comprising:

a. a shaft having a first and a second end;

b. a stop mounted on said shaft providing a starting position of a sliding member;

c. a force capture member movably held at said first end of said shaft;

d. said sliding member slidably mounted on said shaft between said stop and said force capture member;

e. a bore through the length of said shaft within which said force capture member is connected to a restraining member passing through and protruding from said second end of said shaft;

f. whereby said sliding member slides along said shaft between said stop and said force capture member, the striking of said sliding member against said force capture member displaces said force capture member such that the force generated by a swing is quantified for a plurality of results, and said swing training device can be reset to a starting position without significantly altering the training position.

9. The swing training device of claim 8 wherein the striking of said sliding member against said force capture member provides audible, tactile and visual feedback.

10. The swing training device of claim 8 wherein said shaft retains said force capture member when said swing training device is used.

11. The swing training device of claim 8 wherein said stop retains said sliding member in a starting position, whereby said sliding member is maintained in said starting position when said swing training device is held with said first end positioned below said second end.

12. The swing training device of claim 11 further comprising a plurality of magnets or magnetic material incorporated in said stop or said sliding member.

13. The swing training device of claim 8 further comprising a grip and a knob at said second end of said shaft.

14. The swing training device of claim 13 wherein said sliding member, said stop, said force capture member and said knob are of a different color than said shaft and said grip.

15. A method for teaching a user proper elements of an athletic swing, comprising:

a. a user using a swing training device comprising: a shaft having a first and a second end; a movable stop mounted on said shaft providing a plurality of starting positions of a sliding member; a force capture member movably held at said first end of said shaft; said sliding member slidably mounted on said shaft between said movable stop and said force capture member; a bore through the length of said shaft within which said force capture member is connected to a restraining member passing through and protruding from said second end of said shaft;

b. the user configuring said movable stop of the swing training device to place the sliding member in a desired starting position for a desired training method;

c. the user grasping said swing training device in the desired position for performing said desired training method;

d. the user performing said desired training method;

e. upon completing said desired training method the user uses the feedback provided by said swing training device to assess the performance of said training method;

f. the user resetting said swing training device to the desired starting position of said desired training method;

g. the user repeating said desired training method for a desired number of repetitions or until a desired result is achieved.

16. The method of claim 15 wherein said desired training method is intended to teach the proper engagement of said user's wrists when performing an athletic swing, whereby the force generated by said athletic swing is maximized, comprising:

a. the user configuring said swing training device with said movable stop near said second end of said shaft;

b. the user grasping said swing training device below the movable stop at said second end of said shaft while performing said athletic swing, thus causing said, sliding member to travel along said shaft striking said force capture member providing audible, tactile and visual feedback to said user, and displacing said force capture member;

c. the user observing the point during the athletic swing that said audible, tactile and visual feedback occurs, with optimal performance being achieved when said audible, tactile and visual feedback occurs as the users wrists are extended at the ideal moment of the athletic swing;

d. upon completion of said athletic swing, said user observes the displacement of said force capture member thus quantifying the force generated by the swing;

e. the user assessing the performance of said athletic swing based on the timing of said audible, tactile and visual feedback and the displacement of said force capture member;

f. the user resetting said force capture member by pulling said restraining member in the direction opposite of said first end of said shaft, thus quickly resetting the swing training device without significantly altering the training position;

g. the user repeating said athletic swing for a desired number of repetitions or until a desired result is achieved.

17. The method of claim 15 wherein said desired training method is intended to teach the proper engagement of said user's lower body when executing an athletic hip turn, comprising:

a. the user configuring said swing training device with said movable stop near said first end of said shaft;

b. the user holding said swing training device against their hips with their dominant hand at approximately the middle of said shaft and second hand at the second end of said shaft;

c. the user performing an athletic hip turn, thus causing said sliding member to travel along said shaft striking said force capture member providing audible, tactile and visual feedback to said user;

d. the user assessing the performance of said athletic hip turn based on the said audible, tactile and visual feedback;

e. the user resetting said force capture member and said sliding member to the starting position;

f. the user repeating said athletic hip turn for a desired number of repetitions or until a desired result is achieved.

* * * * *